United States Patent [19]

Philip

[11] 4,030,318

[45] June 21, 1977

[54] DIAL AND CYLINDER CONNECTION

[76] Inventor: Morris Philip, c/o Philip Knitting Mills, 26 Bruckner Blvd., Bronx, N.Y. 10454

[22] Filed: Oct. 15, 1975

[21] Appl. No.: 622,480

[52] U.S. Cl. ..... 66/28; 66/147

[51] Int. Cl.[2] ..... D04B 9/06

[58] Field of Search ..... 66/8, 19, 26, 28, 147

[56] References Cited

UNITED STATES PATENTS

| | | | |
|---|---|---|---|
| 1,056,133 | 3/1913 | Swinglehurst | 66/28 |
| 1,121,251 | 12/1914 | Ingalls | 66/28 |
| 1,168,041 | 1/1916 | Williams | 66/28 |
| 1,317,151 | 9/1919 | Ballard | 66/28 |
| 1,433,384 | 10/1922 | Larkin | 66/28 |
| 2,717,510 | 9/1955 | Wilkie | 66/28 |
| 3,222,889 | 12/1955 | Mishcon | 66/28 |
| 3,440,837 | 4/1969 | Mishcon et al. | 66/28 |
| 3,521,466 | 7/1970 | Tannert | 66/19 |

*Primary Examiner*—W. C. Reynolds
*Assistant Examiner*—A. M. Falik

[57] ABSTRACT

A stabilizer for use on circular knitting machines for maintaining alignment between the cylinder and dial during circular knitting of a fabric having a longitudinally extending strip of float yarns between the beginning and end of circularly knit rows of stitches, the stabilizer including a first roller mounted for rotation on the cylinder against one side of the longitudinally extending strip of float yarns, a second roller in mating engagement with the first roller and mounted for rotation on the dial against the other side of the longitudinally extending strip of float yarns and in mating engagement with the first roller and means for driving one of the rollers for feeding the float yarns in the strip between the rollers as the float yarns are engaged between the rollers.

9 Claims, 4 Drawing Figures

DIAL AND CYLINDER CONNECTION

This invention relates to knitting machines and, more particularly, to needle bed stabilizers for such machines, especially, for dial and cylinder circular knitting machines.

Dial and cylinder circular knitting machines utilize two groups of needles. One group are mounted for vertical, reciprocal movement and are commonly referred to as cylinder needles. The other group are mounted for horizontal, reciprocal movement and are commonly referred to as dial needles. The reciprocal movement of the dial and cylinder needles is effected by cams. One set of cams reciprocate the cylinder needles and another set of cams reciprocate the dial needles. The needles and cams are moved, relative to each other, in a direction transverse the direction of reciprocal needle movement.

One of the difficulties heretofore encountered in cylinder and dial circular knitting machines has been in maintaining alignment between the cylinder and dial particularly in machines utilizing 18 or more needles per inch in the cylinder and in the dial. Such alignment is of substantial importance so as to provide proper and uniform knitting and to avoid interference and damage of the reciprocating needles of one group with the reciprocating needles of the other group. In some circular knitting machines, for example the type most commonly employed in circular knitting of sweaters, the cylinder and dial are stationary and the cams for reciprocating the needle in the cylinder and dial are movable. The fabric knit as a tube, passes between the cylinder and the dial. Thus, the dial is surrounded by the knitted fabric tube. The knitted tube isolates the dial from the cylinder.

One arrangement for maintaining alignment between the cylinder and the dial in circular knitting machines and which has, heretofore, been employed with a significant degree of success, employs contacting dogs or rollers. In such arrangement, one set of dogs are mounted at spaced intervals on the needle cylinder and another set of dogs are mounted in fixed position on the dial. The dogs on the cylinder mate with the dogs of the dial. Th axis of the dogs are radial of the dial and cylinder and the fabric of the knitted tube passes between the mating dogs. Rollers on such dogs are rotated by the knitted fabric as such fabric is pulled therebetween.

While effective in maintaining alignment, the dogs of the prior art have been found, in some instance, to have an undesirable effect on the knitted fabric. If not properly adjusted or if such adjustment changes during the knitting of the machine, the dogs can cause distortion and marking of the knitted fabric. Such marking is, of course, undesirable.

In the instant invention many of the difficulties heretofore encounted in maintaining alignment and stability between the cylinder and the dial in circular knitting machines is avoided. Applicant has discovered, in the instant invention, that distortion and marking of the knitting fabric can be avoided, while maintaining alignment and stability between the cylinder and dial, by providing the fabric, as it is being knit, with a longitudinally extending strip of unknitted, or float, threads between the beginning and end of the knit courses and by passing such float yarn strip between a pair of rollers one of which rollers is driven. One of the pair of contacting rollers is mounted on the cylinder and the other is mounted on the dial. For best results, the driven roller is driven at about the speed, or slightly faster than the speed, at which the tube is knitted and fed. The loose, unknitted threads at the float are fed between the rollers without gathering or interfering with the knitted fabric tube.

The invention will be more fully understood from the following description and appended drawing in which the preferred embodiment of the invention is illustrated and in which FIG. 1 is a side view, in elevation and partly in section, of the preferred embodiment of the invention;

Figure 1:
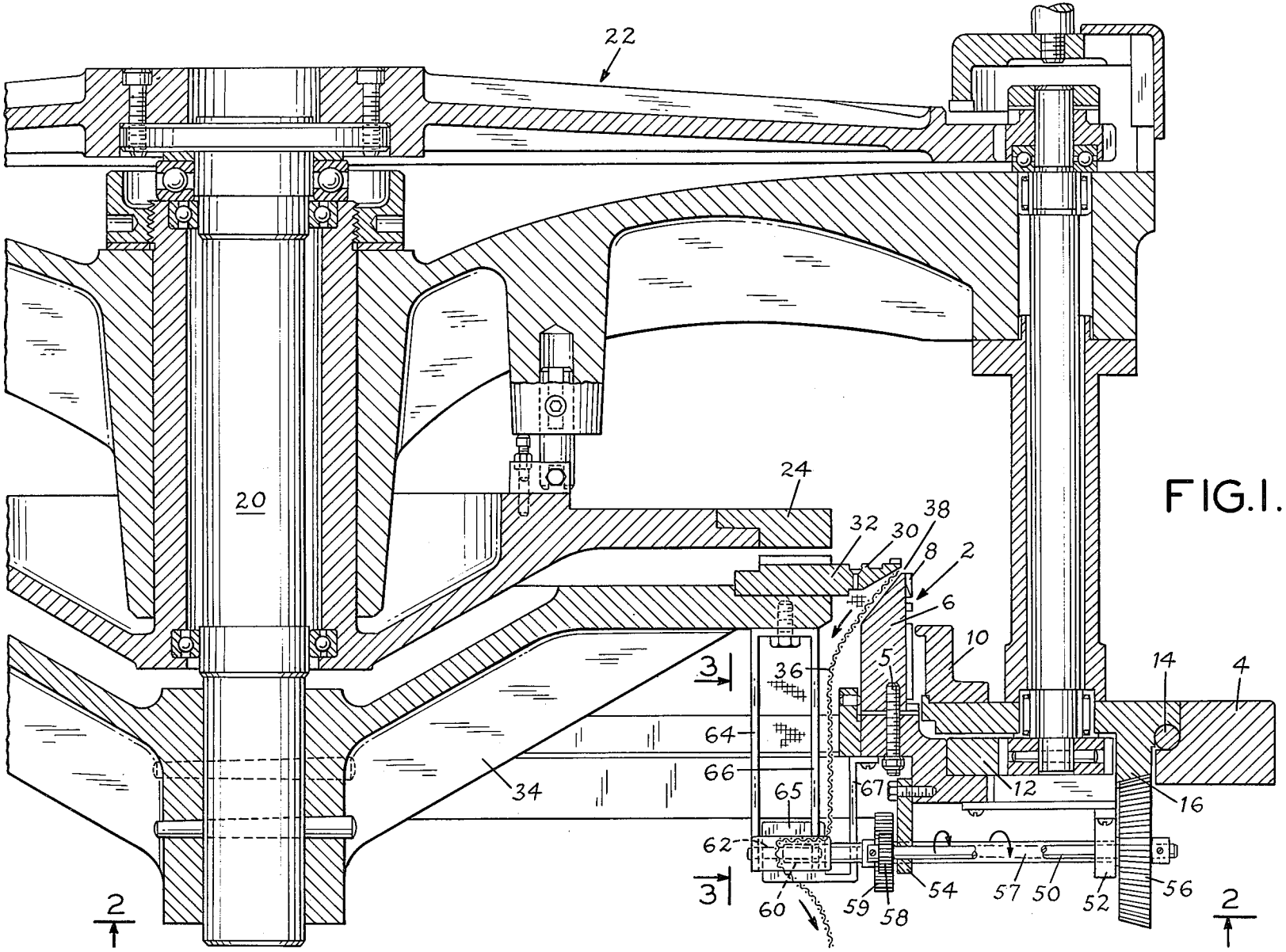

Referring to the drawings, the needle cylinder, generally designated 2, is mounted in fixed position on a frame, not shown, and includes a base 4 and needle cylinder 6 fixed to base 4 at 5. The cylinder needles, not shown, are mounted for vertical, reciprocal movement on cylinder 6 at surface 8. The cylinder needles are vertically reciprocated, in conventional manner, by cylinder cams, not shown, mounted on cylinder ram ring 10. Cam ring 10 is mounted for rotational movement around needle cylinder 2 on bearings 12, 14 on base 4. Cam ring 10 is provided with ring gear 16 and is driven thereby in a manner later described.

Support shaft 20 is mounted in fixed position at the center of the machine on frame, generally designated 22. Dial cams, not shown, are mounted on dial cam support 24 which, in turn, is mounted for rotation about shaft 20. Dial cam support 24 and cylinder cam ring 10 are rotated about shaft 20, the dial cam support and the cylinder cam ring being driven at the same speed so that the cylinder and dial needles, not shown, are reciprocated vertically and horizontally, respectively, in cooperative manner, as in conventional on such machines. The dial needles, not shown, are mounted for horizontal, reciprocal movement at surface 30 of dial 32. Dial 32 is mounted on support shaft 20, in conventional manner, by support 34.

Fabric tube 36 is knitted, in conventional manner, by the hooks of the cylinder and dial needles reciprocated at the adjacent edges of cylinder 2 and dial 30, at 38.

Figure 3:
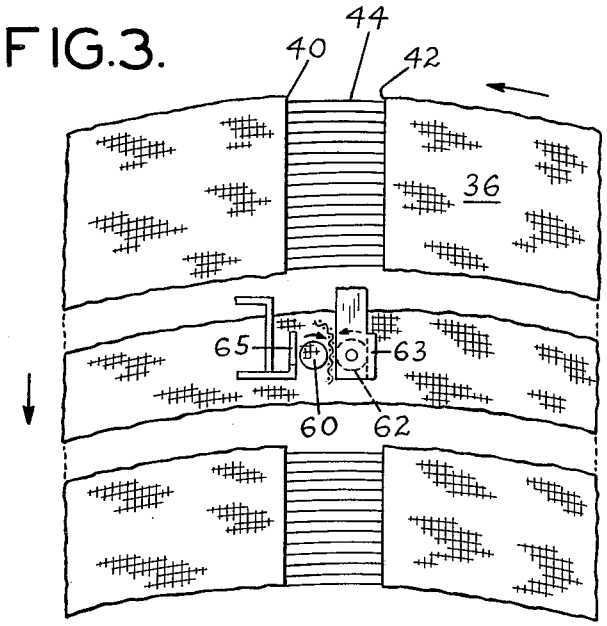
FIG. 3 is a view, taken at 3—3 FIG. 1, and showing a section of the knitted fabric tube.

As best shown in FIG. 3, in knitting tube 36, between the beginning 40 and end 42 of the knitting, the yarn, at 44, is floated. Thus, between the end of the knitting in one revolution of the machine and the beginning of the knitting in the next revolution, there is a connecting width of unknitted or float threads extending longitudinally of the knitted tube. In finishing the fabric, after knitting of the tube has been completed, the knitted tube is layed open to form a flat single thickness fabric width by cutting the knit tube longitudinally along the float yarn strip. The cylinder and the dial, in the instant invention, are maintained in alignment or are stabilized by cooperating rollers engaging opposite sides of the knitted fabric along the float thread strip.

Figure 2:
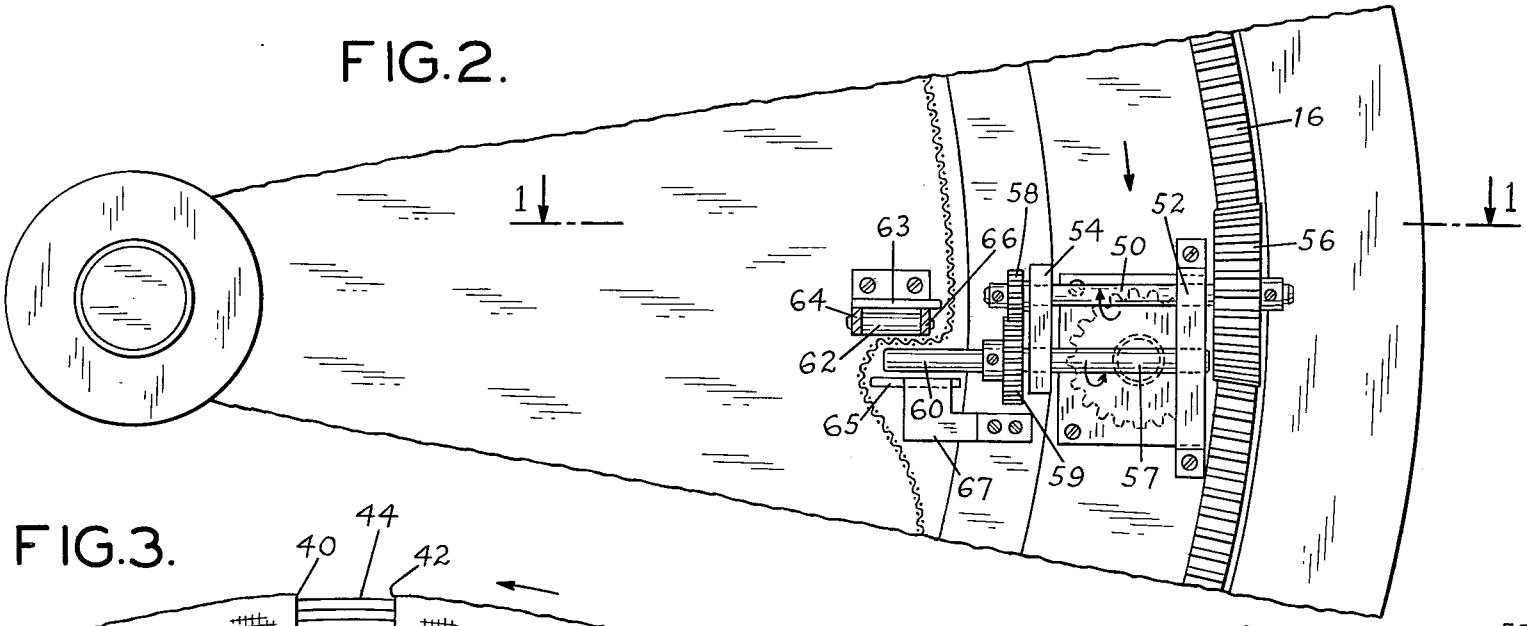
FIG. 2 is a view, taken at 2—2 FIG. 1, and looking upwardly, in the direction of the arrows.
Figure 4:
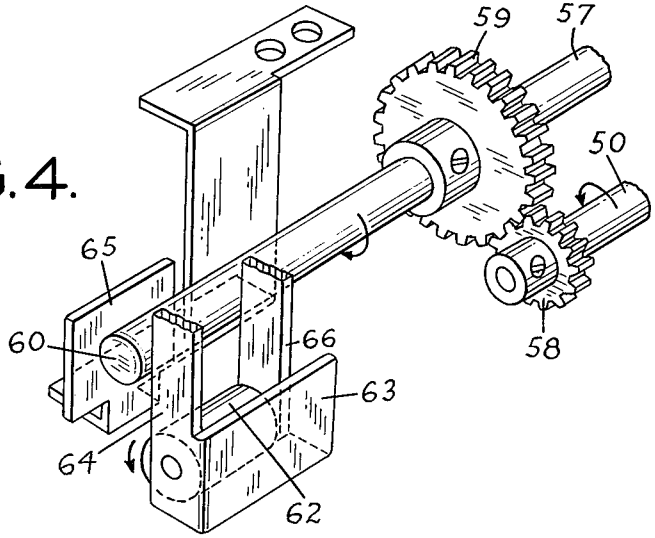
FIG. 4 is a perspective, partially exploded view of the rollers and guides.

As best shown in FIGS. 1 and 2, shaft 50 is mounted for rotation in bearing blocks 52, 54 fixed to cylinder base 4 of needle cylinder 2. Gear 56 is fixed to shaft 50 and is in mesh with ring gear 16 on cam ring 10. Shaft 57 is mounted for rotation in bearing blocks 52, 54 parallel to shaft 50. Gear 58 is fixed to shaft 50 and is in mesh with gear 59 fixed to shaft 57. Cam ring 10 is driven in the direction of the arrow in FIG. 2, in conventional manner, by a motor driven gear in meshing engagement with ring gear 16 or the driving motor may be connected to the outer end of shaft 50 to drive the shaft, cam ring 10 and ring gear 16. In either event, as cylinder cam ring 10 is driven, ring gear 16 drives gear 56 which, in turn, drives gears 58, 59 and shaft 57.

At its inner end 60, shaft 57 extends under dial 30 and parallel to idler roller 62. Roller 62 is mounted by supports 64, 66 on dial 30. The inner end 60 of shaft 57 extends into knitted fabric tube 36 so that tube 36, along float yarn strip 44, passes between inner end 60 of driven shaft 57 and idler roller 62. Fabric guide 63 is fixed to supports 64, 66 and guides fabric 36 around the end of idler roller 62 and support 66. Fabric guide 65 is mounted by support 67 to the bottom of needle cylinder base 4 and guides fabric 36 around the end of driven roller 60.

Idler roller 62 and shaft 57 are adjusted so that end 60 of shaft 57 and idler roller 62 contact the opposite sides of fabric 36 at float yarn strip 44 to maintain alignment between the cylinder and the dial needles. Thus, the relative position of the dial needles relative to the cylinder needles is stabilized by end 60 of shaft 57 and idler roller 62. Interference of the needles of the cylinder with the needles of the dial is avoided.

In the operation of the apparatus of the instant invention, tube 36 is knitted, in conventional manner, by the reciprocation of the cylinder and dial needles as such needles are actuated by the cylinder and dial cam. Thus, as fabric tube 36 is knitted, the knitted tube passes downward between needle cylinder 2 and dial 30. The cylinder and dial needles and the cams are arranged so that, in the area of driven roller end 60 of driven shaft 57 and idler roller 62, the yarn is floated and not knitted. Thus, at float strip 44, FIG. 3, a strip of parallel yarn sections extend between ends 40, 42 of the knitted rows. The float yarn between ends 40, 42 of each knitted row is separated and loose from the float yarn between the ends 40, 42 of the knitted rows above and below.

The loose float yarns is drawn into the bite between end 60 of driven shaft 57 and idler roller 62 by the feed of knitted fabric tube 36 between cylinder 2 and dial 30. As the loose float yarn enters the bite, end 60, which functions as a continuous driven roller, in cooperation with mating idler constant speed roller 62 feeds such loose float yarn past the mating rollers. Each loose float yarn, as it is drawn into the bite of such rollers, is fed past the rollers by end 60 of driven shaft 57. As has already been noted, driven shaft 57 may be driven at the approximate speed of the feed of knitted fabric tube 36 or faster. The float yarn is loose and is not distorted by the rollers. Any marking of the float yarn which might occur as such yarn is fed between the rollers will not detract from the appearance of the knitted fabric because such float yarn is removed when the knit fabric is finished.

The terms and expressions which have been employed are used as terms of description and not of limitation, and there is no intention, in the use of such terms and expressions, of excluding any equivalents of the features shown and described or portions thereof, but it is recognized that various modifications are possible within the scope of the invention claimed.

What is claimed:

1. A stabilizer for use in stabilizing the cylinder and dial of a circular knitting machine, said cylinder being fixedly mounted on a cylinder support ring and said dial being fixedly mounted on a dial support, said stabilizer including a first roller mounted for rotation on said cylinder support ring, a second roller in mating engagement with said first roller mounted for rotation on said dial support and means driving one of said rollers at a continuous constant speed relative to the knitting speed of said knitting machine and regardless of independent velocity of movement of the fabric tube knitted by said machine for engaging the fabric between said rollers and for feeding said engaged fabric past said engaged rollers.

2. A stabilizer, as recited in claim 1, in which said first roller is driven by said driving means.

3. A stabilizer, as recited in claim 2, in which said first roller includes a shaft, said shaft having a gear affixed thereto for driving said shaft and said first roller.

4. A stabilizer, as recited in claim 3, in which said machine includes a cylinder cam ring having a ring gear and gear means in meshing engagement with said ring gear for driving said shaft and said first roller.

5. A stabilizer for use in stabilizing the cylinder and dial of a circular knitting machine having a needle operating cam arrangement in which the fabric circularly knitted by said machines includes a longitudinally extending strip of float yarns extending between the beginning and ends of rows of stitches knitted by said machine, said stabilizer including a first roller mounted for rotation on said cylinder against one side of said longitudinally extending strip of float yarns, a second roller in mating engagement with said first roller mounted for rotation on said dial against the other side of said longitudinally extending strip of float yarns and means driving one of said rollers at a constant speed relative to the knitting speed of said knitting machine for engaging and feeding said float yarns in said strip between said rollers and for feeding said circularly knit fabric past said engaged rollers.

6. A stabilizer, as recited in claim 5, in which said first roller is driven by said driving means.

7. A stabilizer, as recited in claim 6, in which said first roller includes a shaft, said shaft having a gear affixed thereto for driving said shaft and said first roller.

8. A stabilizer, as recited in claim 7, in which said machine includes a cylinder cam ring having a ring gear and gear means in meshing engagement with said ring gear for driving said shaft and said first roller.

9. A method for stabilizing the cylinder and dial of a circular knitting machine while said machine is knitting to maintain alignment between the cylinder and dial needles, the steps comprising forming a longitudinally extending strip of float yarn in said fabric as said fabric is circularly knitted and, while said fabric is being knitted, passing said float yarn strip between a pair of contacting rollers, one of which rollers in said contacting pair is mounted for rotation on the cylinder housing and the other of which rollers is mounted for rotation on the dial housing, and, while passing said float yarn strip between said pair of rollers, driving at least one of said rollers in the direction in which said float yarn is being passed between said rollers to engage and feed said float yarn past said contacting rollers.

* * * * *